US005341969A

United States Patent [19]

Accardo et al.

[11] Patent Number: 5,341,969

[45] Date of Patent: Aug. 30, 1994

[54] CONTAINER ACCOMMODATING PAINT, ROLLER AND BRUSH AND LID THEREFOR

[75] Inventors: Carl A. Accardo, Mauston, Wis.; Kenneth J. Marks, Lake Bluff, Ill.

[73] Assignee: Accamark Partnership, McHenry, Ill.

[21] Appl. No.: 115,108

[22] Filed: Sep. 2, 1993

Related U.S. Application Data

[63] Continuation of Ser. No. 5,813, Jan. 19, 1993, abandoned.

[51] Int. Cl.[5] ..... A47G 19/14

[52] U.S. Cl. ..... 222/465.1; 222/572

[58] Field of Search ..... 222/465.1, 572; 15/257.05, 257.06; 220/697, 570; D32/53.1

[56] References Cited

U.S. PATENT DOCUMENTS

| | | | |
|---|---|---|---|
| D. 186,195 | 9/1959 | Cole | D32/53.1 |
| D. 212,563 | 10/1968 | Tidwell | D32/53.1 |
| D. 248,335 | 6/1978 | Cooke et al. | D32/53.1 |
| 775,526 | 11/1904 | Dunbar | 220/697 |
| 2,287,156 | 6/1942 | White | 222/572 |
| 2,849,158 | 8/1958 | Hopla | 220/697 |
| 3,514,012 | 5/1970 | Martin | 15/257.06 |
| 3,828,389 | 8/1974 | Heisler | 15/257.06 |
| 4,094,431 | 6/1978 | Wheeler | 15/257.06 |
| 4,164,299 | 8/1979 | Fuhr | 220/20 |
| 4,297,762 | 11/1981 | Crysdale | 15/257.06 |
| 4,509,226 | 4/1985 | Allison et al. | 15/257.06 |
| 4,756,046 | 1/1988 | Surface et al. | 15/257.06 |
| 5,046,749 | 9/1991 | Owens | 280/79.5 |
| 5,054,661 | 10/1991 | Hollje | 222/465.1 |
| 5,207,348 | 5/1993 | Fischer et al. | 220/697 |

*Primary Examiner*—Andres Kashnikow
*Assistant Examiner*—Philippe Derakshani
*Attorney, Agent, or Firm*—Roper & Quigg

[57] ABSTRACT

A container suitable for holding paint incorporating a first open receptacle having integrated therein a paint distribution board for use with a paint roller and a second open receptacle suitable both for holding a paint brush and to serve as a means for pouring liquid from the container. A lid suitable for covering the container.

37 Claims, 3 Drawing Sheets

CONTAINER ACCOMMODATING PAINT, ROLLER AND BRUSH AND LID THEREFOR

This application is a continuation application of application Ser. No. 08/005,813, filed Jan. 19, 1993, now abandoned.

BACKGROUND OF THE INVENTION

1. Field of the Invention

This invention relates to containers. In one of its aspects it relates to containers with fitted lids. In another of its aspects it relates to containers useful in the handling of paint. In yet another of its aspects it relates to equipment used for painting.

2. Description of the Prior Art

Many containers have been described that are useful for the storage of paint or for use during the process of active painting. Most containers used for the storage of paint are simply lidded containers that can be covered tightly when paint is to be held for a period between times of active use. Most containers intended for use during the process of active painting are variants of open topped containers that perhaps have a specialized convenience attached, such as a brush holder or a brush stroking edge as is illustrated in U.S. Pat. No. 4,164,299, which discloses a hand held, double receptacle tray having a compartment for paint and an adjacent compartment in which a brush can be deposited. This patent also discloses a container with stroking edges against which paint can be wiped from the brush and returned to the container both down the inside of the container and from a collection trough on the outside of a stroking edge through corner gaps back into the inside of the container. These corner gaps are also useful as a means by which paint can be poured from the container.

Since much painting is done with rollers, it would be advantageous for a paint container to have as a permanent part of the container a corrugated board across which a paint roller can be rubbed to distribute the paint on the roller. There is an added need, however, to provide stability to the container when the roller is moved up the corrugated surface of an internal paint distribution board in a paint container.

It is also advantageous, even when the majority of the surface is being painted with a roller, to have a brush handy for tight corners, edges or touch up work. When using either a roller, a brush or both, it would be convenient, if called away from the painting task, to be able to cover the paint container to protect the paint without having to place the roller or brush outside of the container.

It is, therefore, an object of this invention to provide a paint container that has an internal, paint distribution board as an integral part of the container and that remains stable when the paint distribution board is used.

It is another object of the invention to provide a container with a compartment for each of a roller and a brush, with provision for holding paint in either compartment.

It is another object of this invention to provide means by which the handle of a paint roller can be secured to the container.

It is still another object of this invention to provide a container with facilitated means for pouring the contained liquid.

It is a further object of this invention to provide containers that are nestable to facilitate storage or shipping.

It is yet another object of this invention to provide a lid for the container that allows the roller or brush to be retained in its compartment when the container is sealed with a cover.

These and other aspects, objects and the various advantages of this invention will become apparent upon reading this specification and studying the appended drawing and claims.

DESCRIPTION OF THE PRESENT INVENTION

Figure 1:
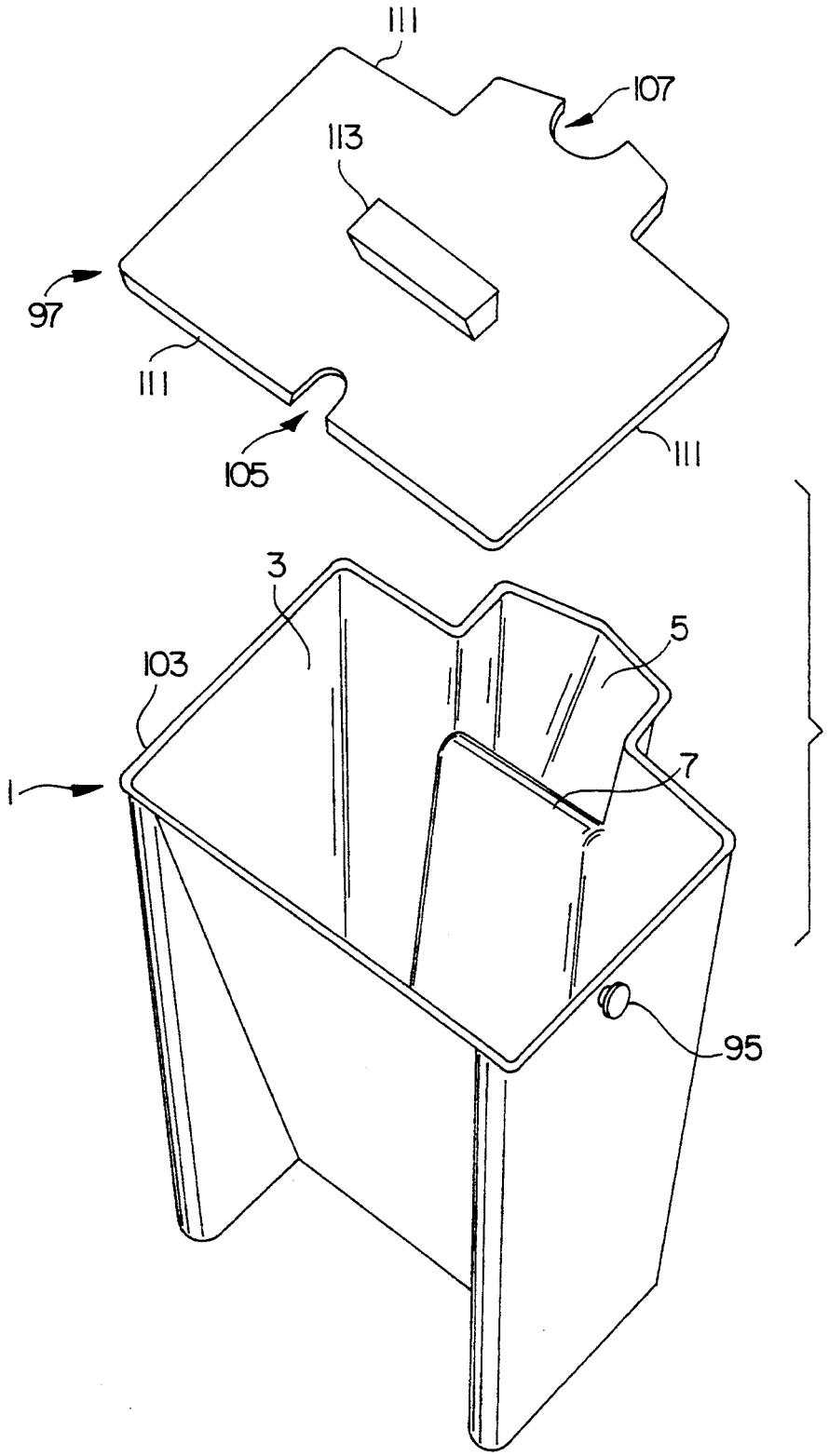
FIG. 1 is a view in perspective of the container and lid of the present invention.
Figure 2:
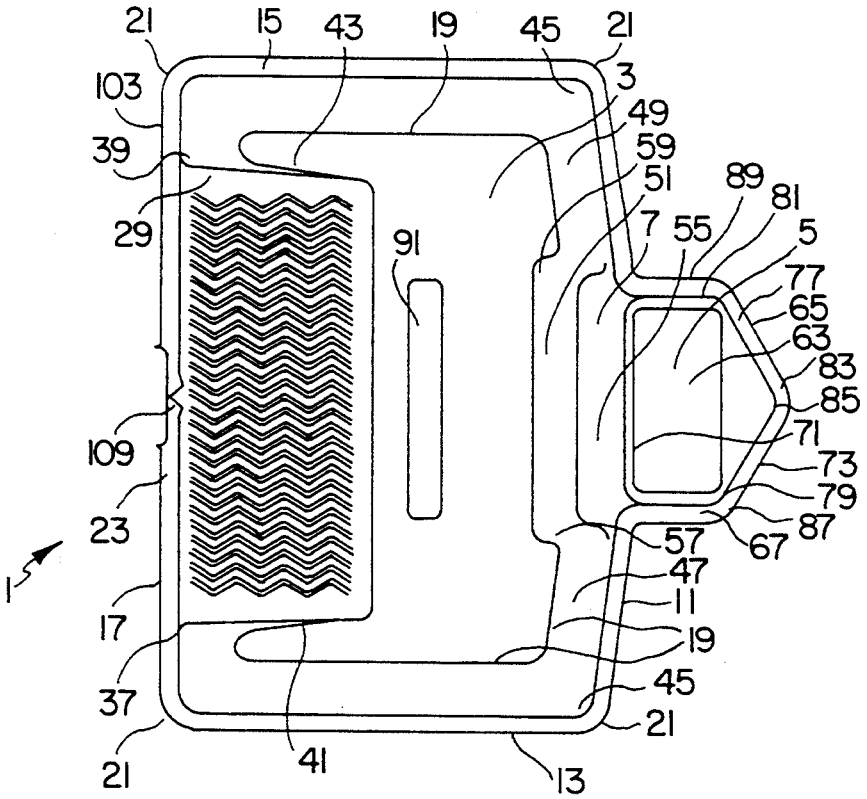
FIG. 2 is a plan view of the container of the present invention (without lid).
Figure 3:
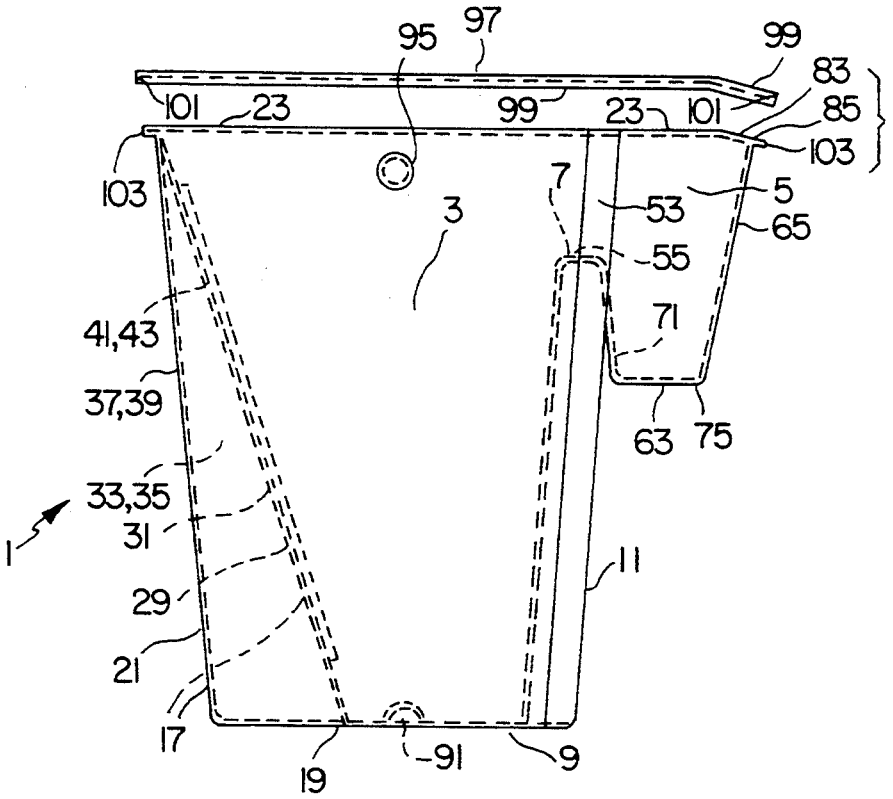
FIG. 3 is a view from the side of the container and lid of the present invention.
Figure 4:
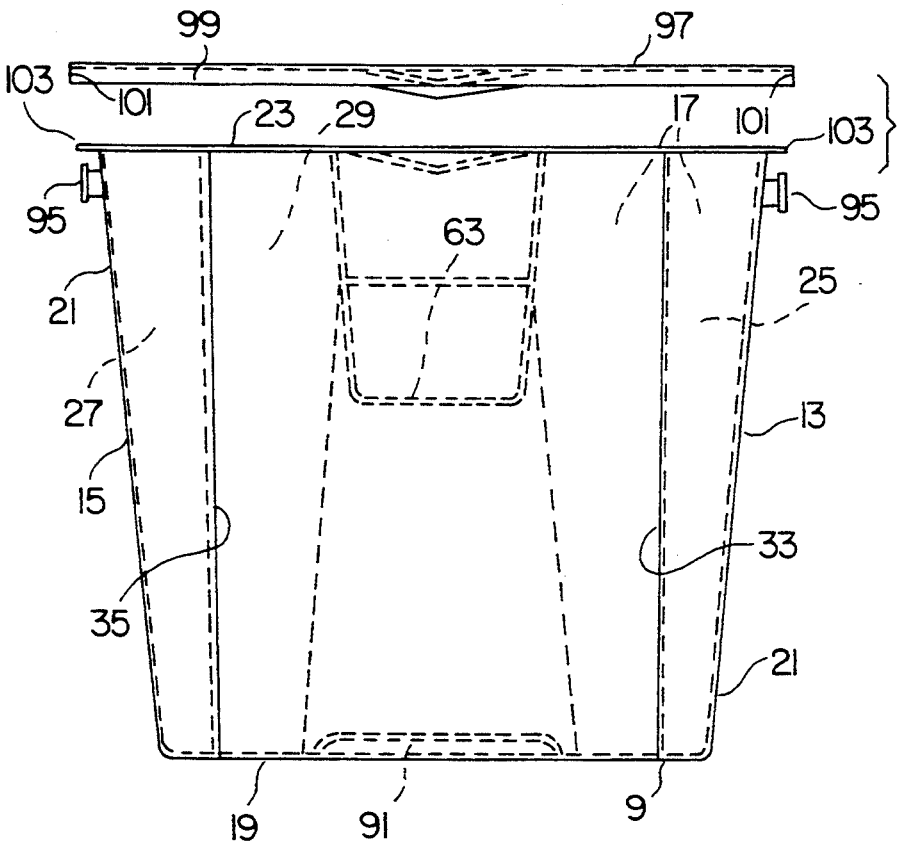
FIG. 4 is a view from the rear of the container and lid of the present invention.
Figure 5:
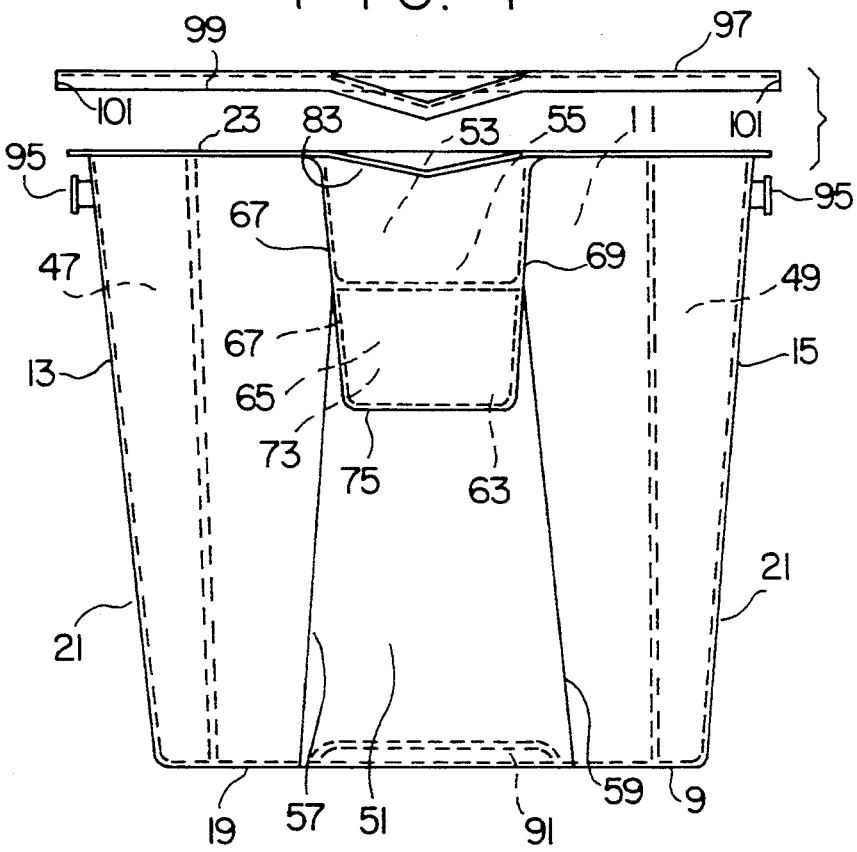
FIG. 5 is a view from the front of the container and lid of the present invention.

According to this invention a container is provided which has as integrated components: a first open receptacle, a second open receptacle and a continuous, transition panel closing the top of an inset between the two receptacles.

The first open receptacle has as components: (1) a first bottom wall, (2) a first front wall, (3) two first side walls and (4) a first rear wall. Each of the first front wall, first side walls and first rear wall is fixedly attached at its lower edge to an edge of the first bottom wall and at its side edges to a side edge of an adjacent first wall thereby forming a first open receptacle for holding a quantity of liquid.

The first rear wall (4) forms an upper edge continuous with and perpendicular to the upper edge of each first side wall and with the upper edge in a plane parallel to the plane of the first bottom wall. The first rear wall is made up of: (a) two quadrilateral, support panels of equal size, one of the support panels adjoining each first side wall; (b) a central, quadrilateral panel, sufficiently wide to accommodate the roller of a paint roller, the edge of the quadrilateral panel adjoining the first bottom wall sufficiently inset from the continuous upper edge of the first rear wall to form an incline between the edge adjoining the first bottom wall and the upper edge and (c) two triangular support panels, each adjoining the quadrilateral support panels with a side edge of each triangular panel fixedly attached to an adjoining edge of a quadrilateral support panel and an edge fixedly attached to an edge of the central, quadrilateral panel.

The first front wall (2) forms an upper edge continuous with the upper edge of the adjacent first side wall and with the upper edge in a plane parallel to the plane of the first bottom wall and forms, inside the first open receptacle, an obtuse angle with the upper edge of the adjacent first side wall. The first front wall is made up of: (a) two quadrilateral, support panels of equal size, one of the support panels adjoining each first side wall forming an obtuse angle therewith, inside the first open receptacle; (b) a central, quadrilateral panel the edge of which adjoining the first bottom wall is parallel to the bottom edge of the central, quadrilateral panel of the first rear wall and inset from a plane that includes the edges at which the support panels adjoin the first front wall, the central, quadrilateral panel sized so that an opening is formed between its upper edge and the plane containing the upper edges of the first side walls and (c) two transition moldings, each transition molding joining an edge of the central, quadrilateral panel to an edge of a quadrilateral, support panel and each transition molding sized along the upper edge of said central, quadrilateral panel, to form a continuous, transition panel.

The continuous, transition panel is in a plane parallel to the first bottom wall and sized to close the inset area formed between the transition moldings at their upper edge.

The second open receptacle has as components: (1) a second bottom wall, (2) a second front wall, (3) two second side walls and (4) a second rear wall. Each of the second front wall, second side walls and second rear wall is fixedly attached at its lower edge to an edge of the second bottom wall and at its side edges to a side edge of an adjacent second wall thereby forming the second open receptacle.

The second rear wall (4) is fixedly attached to an edge of the continuous, transition panel and sized so that the second open receptacle has sufficient depth to retain a quantity of liquid. The second side walls (3) each form an upper edge continuous with the upper edge of the adjacent quadrilateral, support panel of the first open receptacle. This upper edge is in a plane parallel to the plane of the first bottom wall. The second side walls are sized to mate in fixed attachment with the second front wall, the second rear wall and the second bottom wall.

The second bottom wall (1) is in a plane parallel to the plane of the first bottom wall.

The second front wall (2) is made up of a quadrilateral panel molded in fixed attachment at one edge with the second bottom wall and at the edges adjacent thereto molded in fixed attachment with the second side walls. The remaining edge forms an equal, obtuse angle with the upper edge of each of the side walls inside the second open receptacle thereby providing a spout for pouring.

In a preferred embodiment of the invention (1) each of said front panel, side panels and rear panel of each of said first and second open receptacles is sufficiently longer at its upper than at its lower edge, (2) each of said central, quadrilateral panel of said first rear wall of said first open receptacle and said central, quadrilateral panel of said first front wall of said first open receptacle is sufficiently longer at its lower than at its upper edge and (3) said continuous transition panel is sized so that said container is nestable with a duplicate container.

Also according to this invention there is provided a continuous surface lid having a depending lipped edge with the depending lipped edge sized for its inner surface to engage the outer surface of the continuous edge formed by the upper edge of the second front wall, quadrilateral panel and the upper edges of all portions of walls forming the outer periphery of the container so that the container is covered.

In a preferred embodiment of this invention the lid has (1) a cut out portion at the edge adjacent the central, quadrilateral panel of the first rear wall with the cut out portion sized to accommodate the handle of a paint roller, (2) a cut out portion located within the periphery of the second open container with the cut out portion sized to accommodate the handle of a paint brush or (3) the lid has both (1) and (2).

DESCRIPTION OF THE PREFERRED EMBODIMENTS

In FIGS. 1-5 of the Drawing like numbers denote like features. A container of the present invention is indicated by reference numeral 1. This container can be described as having as integrated components: a first open receptacle 3, a second open receptacle 5 and a continuous, transition panel 7 closing the top of an inset between the two receptacles.

The first open receptacle 3 provides containment for a charge of paint, lacquer, stain, adhesive, paste, cleaning fluid or similar liquid or suspension and is sized to be sufficiently wide to accommodate the roller portion of a paint roller. This receptacle can contain means for distributing paint onto a paint roller and provides the stability necessary to fully utilize a paint distribution board integrated into the container.

This receptacle is made up of a first bottom wall 9, a first front wall 11, two first side walls 13,15 and a first rear wall 17. Each of the first front wall 11, first side walls 13,15 and first rear wall 17 is fixedly attached at its lower edge to an edge 19 of the first bottom wall 9 and at its side edges 21 to a side edge 21 of an adjacent first wall thereby forming a first open receptacle 3 for holding a quantity of liquid.

The first rear wall 17 forms an upper edge 23 continuous with and perpendicular to the upper edge 23 of each first side wall 13,15 and with the upper edge in a plane parallel to the plane of the first bottom wall 9.

The first rear wall 17 is made up of: (a) two quadrilateral, support panels 25,27 of equal size, one of the support panels adjoining each first side wall 13,15; (b) a central, quadrilateral panel 29, sufficiently wide to accommodate the roller of a paint roller, the edge of the central, quadrilateral panel 29 adjoining the first bottom wall 9 sufficiently inset from the continuous upper edge 23 of the first rear wall 17 to form an incline 31 between the edge 19 adjoining the first bottom wall 9 and the upper edge 23 and (c) two triangular support panels 33,35, each adjoining the quadrilateral support panels 25,27 with a side edge 37,39 of each triangular panel fixedly attached to an adjoining edge of a quadrilateral support panel 25,27 and a panel edge 41,43 fixedly attached to an edge of the central, quadrilateral panel 29.

The characteristics of the first rear wall 17 provide novel features to the container of this invention in that the combination of (a) the inset of the central, quadrilateral panel 29 at the edge at which it joins the first bottom wall 9 to form a slanted, paint distribution board that is built into the container structure and (b) the support given by the structure resulting from the arrangement of the two triangular support panels 33,35; the two quadrilateral, support panels 25,27 and the side walls 13,15 allow a paint roller to be rubbed against the paint distribution board without fear of overturning the container. The base of the central, quadrilateral panel 29 can be inset by any distance needed to provide the amount of slope determined as desirable for the paint distribution board, but the inset will generally be less than half the distance across the first bottom wall 9, so that there is adequate room in the base of the container for the contained liquid. The paint distribution board will usually be formed with a corrugated upper surface which can take the form of a design such as herringbone. The corrugated surface is an aid in the distribution of paint on the roller.

The first front wall 11 forms an upper edge 23 continuous with the upper edge 23 of the adjacent first side wall and with the upper edge 23 in a plane parallel to the plane of the first bottom wall 9 and forms, inside the first open receptacle 3, an obtuse angle 45 of up to 115°, preferably up to about 105°, and most preferably about 98° with the upper edge 23 of the adjacent first side wall 13,15.

The first front wall 11 is made up of: (a) two quadrilateral, support panels 47,49 of equal size, one of the support panels adjoining each first side wall 13,15 forming an obtuse angle of up to 115°, preferably up to about 105°, and most preferably about 98° therewith, inside the first open receptacle 3; (b) a central, quadrilateral panel 51 the edge of which adjoining the first bottom wall 9 is parallel to the bottom edge of the central, quadrilateral panel 29 of the first rear wall and inset from a plane that includes the edges at which the support panels 47,49 adjoin the first front wall 11, the central, quadrilateral panel 51 sized so that an opening 53 is formed between its upper edge 55 and the plane containing the upper edges of the first side walls 13,15 and (c) two transition moldings 57,59, each transition molding joining an edge 61 of the central, quadrilateral panel 51 to an edge of a quadrilateral, support panel 47,49 and each transition molding 57,59 sized along with the upper edge 61 of said central, quadrilateral panel 51, to form a continuous, transition panel 7.

The continuous, transition panel 7 is in a plane parallel to the first bottom wall 9 and sized to close the inset area formed between the transition moldings 57,59 at their upper edges 61. The continuous, transition panel 7 provides a flattened lip that closes the gap at the top of the inset formed by the juncture of the central, quadrilateral panel 51 and the transition moldings 57,59. This lip connects the first and second receptacles and allows liquid to be poured from the first open receptacle to the second open receptacle.

The second open receptacle 5 is of relatively lesser dimensions than the first open receptacle 3 and serves two major functions of the container of this invention: (1) this receptacle is sized to receive and retain a paint brush and an amount of paint to be used in conjunction with the paint roller for which the first open receptacle is used and (2) this receptacle serves as a spout from which the paint can be easily decanted.

The second open receptacle 5 has as components: a second bottom wall 63, a second front wall 65, two second side walls 67,69 and a second rear wall 71. Each of the second front wall 65, second side walls 67,69 and second rear wall 71 is fixedly attached at its lower edge to an edge 73 of the second bottom wall 63 and at its side edges 65 to a side edge 65 of an adjacent second wall thereby forming the second open receptacle 5.

The second rear wall 71 is fixedly attached to an edge of the continuous, transition panel 7 and sized so that the second open receptacle 5 has sufficient depth to retain a quantity of liquid. The second side walls 67,69 each form an upper edge 23 continuous with the upper edge 23 of the adjacent quadrilateral, support panel 47,49 of the first open receptacle. This upper edge 23 is in a plane parallel to the plane of the first bottom wall 9. The second side walls 67,69 are sized to mate in fixed attachment with the second front wall 65, the second rear wall 71 and the second bottom wall 63.

The second bottom wall 63 is in a plane parallel to the plane of the first bottom wall 9.

The second front wall 65 is made up of a quadrilateral panel 73 molded in fixed attachment at one edge 75 with the second bottom wall 63 and at the edges adjacent thereto molded in fixed attachment with the second side walls 67,69. The remaining edge 77 forms an equal, obtuse angle 79,81 of up to 130°, preferably 120° with the upper edge 23 of each of the side walls 67,69 inside the second open receptacle 5 thereby providing a spout 83 for pouring.

The quadrilateral panel 75 which makes up the second front wall 65 of the second open receptacle is molded as a single panel so that the edge 73 that joins the second bottom wall 63 is of equal length with the edge of the bottom wall to which it is joined. The edges adjoining the second side walls 67,69 are also equal in length to the edges to which they are joined. The remaining edge 77, however, is extended in the molding process to form a spout 83 so that this edge forms an obtuse angle with each of the side walls within the receptacle and the center 85 of the edge is extended forward from the plane containing the edges of the walls to which the second front wall is joined and the remaining edge is longer than the distance between the most forward point 87,89 of the upper edges of the side walls.

For practical purposes, which depend on the viscosity of the liquid to be poured from the spout 83, the remaining edge 77 of the quadrilateral panel 75 can form a continuous edge 23 in the same plane as the upper edge 23 of the rest of the first and second open receptacles or the plane in which the remaining edge 77 lies can extend at an angle inclined upward or downward from the plane in which the upper edge of the rest of receptacles lie. A practical limit for the angle of inclination is considered to be about 15° either upward or downward, although angles of greater degree are certainly feasible. It is presently preferred that the spout 83 be at an angle declined about 10° from the plane in which the upper edge 23 of the rest of the first and second open receptacles lies. The continuous upper edge 23 of the container formed by the upper edges of all portions of walls forming the outer periphery of the container and the upper edge of the second front wall, quadrilateral panel 77 can be molded into a continuous edge or it can be molded into a flattened, continuous lip or a depending, continuous lip.

In a preferred embodiment of the present invention the dimensions of the containers are sized to make them nestable so that a maximum number of items can be maintained in a minimum space for storage and shipping. For the containers to be nestable the dimensions of the exterior surfaces of the walls must be sufficiently less at the edges 19 at which they adjoin the bottom wall than at their upper extremities 23 and the dimensions of the wall portions forming insets must be sufficiently more at the edges at which they adjoin the bottom wall than at their upper extremities that one container can fit within another. This is expressed in another way as: (1) each of the front wall 11,65; side walls 13,15,67,69 and rear wall 17,71 of each of the first and second open receptacles 3,5 is sufficiently longer at its upper edge 23 than at the edge 19 that adjoins the bottom wall 9, (2) each of the central, quadrilateral panel of said first rear wall 29; the central, quadrilateral panel 51 and the two transition moldings 57,59 of the first front wall of the first open receptacle 3 is sufficiently longer at the edge 19 that adjoins the bottom wall 9 than at its upper edge 23 and (3) the continuous transition panel 7 is sized so that the container is nestable with a duplicate container.

The container can be equipped with means that aid in handling the container when liquid is being poured from the spout. A groove 91, typically a half cylinder, can be molded into the first bottom wall 9. The groove 91 is inset from the outside of the first receptacle 3 with the length of the groove parallel to the edge formed by the junction 19 of the first bottom wall 9 and the central, quadrilateral panel 29 of the rear wall. The distance of the groove from the edge formed by the junction of the first bottom wall 9 and the central, quadrilateral panel 29 of the rear wall is not critical, but ideally falls within the span to give a normal hand a fingerhold within the groove 91 while bracing the thumb against the rear wall 17 of the container.

The container can also be equipped with handle means 93 for carrying. Any means normally used as handles for containers is suitable. The container can be equipped with holes near the top 23 of the first side walls 13,15 into which a bail is inserted or lugs 95 can be molded on the outside of the first side walls onto which a bail is attached. The addition of appurtenances to the outside of the container should be sufficiently near the upper edge of the container to minimize interference with the nestability of the container.

The material of construction for the container of this invention can be chosen from any material that can be molded into the container described above. Among these materials are: metals, plastics, paper and paper products, and fiberboard products. Presently preferred are thermoplastics such as polymers of olefins, polymers of styrene, polymers of arylene sulfide, and the like. More preferred are flexible polyolefins and flexible copolymers of styrene, with styrene-butadiene polymer, currently, the most preferred.

Within the purview of this invention is the addition of a lid 97 or cover to the container. There are times when engaged in the painting process that one must leave the project for a sufficient amount of time that it would be advantageous to cover the container. The present invention provides a cover that allows not only the paint but also the paint roller and the brush to be left in the container.

Referring to FIGS. 2–5 of the drawing, a continuous surface lid 97 is shown having a depending, lipped edge 99. The depending, lipped edge 99 is sized for its inner surface 101 to engage the outer surface 103 of the continuous edge formed by the upper edges 23 of all portions of walls forming the outer periphery of the container and the upper edge 77 of the second front wall, quadrilateral panel thereby covering the container. When the upper edge 77 of the second front wall, quadrilateral panel is inclined in relation to the rest of the upper edge 23 of the container, the part of the lid that engages the upper edge of the second front wall, quadrilateral panel can be molded to lie in a plane that is inclined upward or downward from the rest of the lid thereby corresponding to the orientation of the upper edge of the second front wall, quadrilateral panel. When the angle of inclination is 5° or less molding an inclined portion of the lid is not a necessity.

In another embodiment of the invention, as shown in FIG. 1, the lid 97 has edges 111 that are tapered from the outer side of the lid to the inner side of the lid to engage the slope of the tapered inner walls of the container. With this configuration the lid is more easily removed when equipped with a handle 113 which can be of any convenient shape but which is illustrated here as having a presently preferred wedge shape.

Generally the lid is used simply to minimize the circulation of air over the paint, roller or brush so an air-tight seal between the lid and the container is not sought. Other configurations of the lid by which the lid is fitted to the container are also contemplated by the invention, such as (1) providing an extension of the area of the lid to match the outer extension of the upper edge that forms the top of the container and (2) providing a sloped extension on the inner side of the lid around the inner periphery of the top of the container to engage the inner surface of the container thereby centering the lid on the container. The lid can also have both the circumferential sloped extension inside the edge of the container and the depending lip on the outside the edge of the container. A lid with any of these edge configurations can be equipped with a handle.

In a preferred embodiment of this invention there are portions cut out of the lid 97: (a) a first cut out portion 105 at the edge of the lid adjacent the central, quadrilateral panel of the first rear wall with this cut out portion sized to accommodate the handle of a paint roller, (b) a second cut out portion 107 located within the periphery of the second open receptacle 5 with the cut out portion sized to accommodate the handle of a paint brush or (3) the lid has both types of cut out section in the same lid.

In another embodiment of the invention the central, quadrilateral panel of the first rear wall 29 is equipped with means for retaining the handle of a paint roller so that the roller handle remains in place against the first rear wall. The handle retaining means 109 is preferably a molded dimple or slit, sized so that the wire handle of a paint roller can be pressed into the space between the two sides of the dimple or slit and retained there.

The material of construction for the lid of this invention can be chosen from any material that can be molded into the lid described above. Among these materials are: metals, plastics, paper and paper products, and fiberboard products. Presently preferred are thermoplastics such as polymers of olefins, polymers of styrene, polymers of arylene sulfide, and the like. More preferred are flexible polyolefins and flexible copolymers of styrene, with styrene-butadiene polymer, currently, the most preferred.

The invention thus being described, it will be obvious that the same may be varied in many ways. Such variations are not to be regarded as a departure from the spirit and scope of the invention and all such modifications are intended to be included within the scope of the following claims.

What is claimed is:

1. A container comprising:

(A)a first open receptacle comprising:

(1) a first bottom wall, (2) a first front wall, (3) two first side walls, (4) a first rear wall, each of said first front wall, first side walls and first rear wall fixedly attached at its lower edge to an edge of said first bottom wall and at its side edges to a side edge of an adjacent first wall to form said first open receptacle for holding a quantity of liquid;

said first rear wall (A) (4) forming an upper edge continuous with and perpendicular to the upper edge of each first side wall and with said upper edge in a plane parallel to the plane of said first bottom wall, said first rear wall comprising:

(a) two quadrilateral, support panels of equal size, one of said support panels adjoining each first side wall;

(b) a central, quadrilateral panel, of sufficient width to accommodate the roller of a paint roller, the edge of said panel adjoining said first bottom wall sufficiently inset from the continuous upper edge of said first rear wall to form an incline between the edge adjoining said first bottom wall and said upper edge; and (c) two triangular support panels, each adjacent to said quadrilateral support panels with a side edge of each fixedly attached to an adjoining edge of a quadrilateral support panel and an edge fixedly attached to an edge of said central, quadrilateral panel;

said first front wall (A) (2) forming an upper edge continuous with the upper edge of the adjacent first side wall and with said upper edge in a plane parallel to the plane of said first bottom wall and forming, inside said first open receptacle, an obtuse angle with the upper edge of the adjacent first side wall, said first front wall comprising:

(a) two quadrilateral, support panels of equal size, one of said support panels adjoining each first side wall forming an obtuse angle therewith, inside said first open receptacle;

(b) a central, quadrilateral panel the edge of which adjoining said first bottom wall is parallel to the bottom edge of said central, quadrilateral panel of said first rear wall and inset from a plane that includes the edges at which said support panels adjoin said first front wall, said central, quadrilateral panel sized so that an opening is formed between its upper edge and the plane containing the upper edges of said first side walls; and (c) two transition moldings, each transition molding joining an edge of said central, quadrilateral panel to an edge of a quadrilateral, support panel and each transition molding sized along with the upper edge of said central, quadrilateral panel, to form;

(B) a continuous, transition panel, said continuous, transition panel in a plane parallel to said first bottom wall and sized to close the inset area formed between said transition moldings at their upper edge, (C) a second open receptacle comprising:

(1) a second bottom wall, (2) a second front wall, (3) two second side walls, (4) a second rear wall, each of said second front wall, second side walls and second rear wall fixedly attached at its lower edge to an edge of said second bottom wall and at its side edges to a side edge of an adjacent second wall to form said second open receptacle, said second rear wall (C) (4) fixedly attached to an edge of said continuous, transition panel and sized so that said second open receptacle has sufficient depth to retain a quantity of liquid;

said second side walls (C) (3), each forming an upper edge continuous with the upper edge of the adjacent quadrilateral, support panel of said first open receptacle and with said upper edge in a plane parallel to the plane of said first bottom wall, said second side walls sized to mate in fixed attachment with said second front wall, said second rear wall and said second bottom wall;

said second bottom wall (C) (1) in a plane parallel to the plane of said first bottom wall; and said second front wall (C) (2) comprising a quadrilateral panel molded in fixed attachment at one edge with said second bottom wall and at the edges adjacent thereto in fixed attachment with said second side walls with the remaining edge forming an equal, obtuse angle with the upper edge of each of said side walls inside said second open receptacle thereby forming a spout for pouring.

2. A container according to claim 1 wherein the dimensions of said container are sized so that said container is nestable with a duplicate container.

3. A container according to claim 2 wherein (1) each of said front wall, side walls and rear wall of each of said first and second open receptacles is sufficiently longer at its upper edge than at the edge that adjoins the bottom wall, (2) each of said central, quadrilateral panel of said first rear wall; said central, quadrilateral panel and said two transition moldings of said first front wall of said first open receptacle is sufficiently longer at the edge that adjoins the bottom wall than at its upper edge and (3) said continuous transition panel is sized so that said container is nestable with a duplicate container.

4. A container according to claim 2 wherein said first bottom wall has a groove, said groove inset from the outside of said first receptacle with the length of said groove parallel to the edge formed by the junction of said first bottom wall and said central, rectangular panel.

5. A container according to claim 2 wherein the upper edge of each one of said two quadrilateral, support panels of equal size, adjoining the upper edge of each first side wall forms therewith an obtuse angle of 98° inside said first open receptacle.

6. A container according to claim 2 wherein said second front wall, quadrilateral panel is molded with said remaining edge forming an equal, obtuse angle of 120° with the upper edge of each of said side walls inside said second open receptacle.

7. A container according to claim 6 wherein said remaining edge of said second front wall, quadrilateral panel is in the same plane as the upper edge of each of said side walls of said second open receptacle.

8. A container according to claim 6 wherein said remaining edge of said second front wall, quadrilateral panel is in a plane declined 10° from the plane of the upper edge of each of said side walls of said second open receptacle.

9. A container according to claim 6 wherein said remaining edge of said second front wall, quadrilateral panel is in a plane inclined 10° upward from the plane of the upper edge of each of said side walls of said second open receptacle.

10. A container according to claim 2 wherein said continuous upper edge of said central, quadrilateral panel of said first rear wall comprises a means for securing the handle of a paint roller.

11. A container according to claim 10 wherein said means for securing the handle of a paint roller is centered on said continuous upper edge of said central, quadrilateral panel of said first rear wall.

12. A container according to claim 7 wherein said remaining edge of said second front wall, quadrilateral panel forms a continuous lipped edge with the upper edges of all portions of walls forming the outer periphery of said container.

13. A container according to claim 8 wherein said remaining edge of said second front wall, quadrilateral panel forms a continuous lipped edge with the upper edges of all portions of walls forming the outer periphery of said container.

14. A container according to claim 9 wherein said remaining edge of said second front wall, quadrilateral panel forms a continuous lipped edge with the upper edges of all portions of walls forming the outer periphery of said container.

15. A container according to claim 2 wherein said central, quadrilateral panel of said first rear wall (A) (4) has a corrugated surface on the inside of said container.

16. A continuous surface, flat lid having a depending lipped edge said depending lipped edge sized for its inner surface to engage the outer surface of said continuous lipped edge of claim 12 thereby covering said container.

17. A lid according to claim 16 comprising a cut out portion at the edge adjacent said central, quadrilateral panel of said first rear wall (A) (4) said cut out portion sized to accommodate the handle of a paint roller.

18. A lid according to claim 16 comprising a cut out portion located within the periphery of said second open container said cut out portion sized to accommodate the handle of a paint brush.

19. A lid according to claim 18 also comprising a cut out portion at the edge adjacent said central, quadrilateral panel of said first rear wall (A) (4) said cut out portion sized to accommodate the handle of a paint roller.

20. A continuous surface lid having a depending lipped edge said depending lipped edge sized for its inner surface to engage the outer surface of said continuous lipped edge of claim 13 thereby covering said container.

21. A lid according to claim 20 comprising a cut out portion at the edge adjacent said central, quadrilateral panel of said first rear wall (A) (4) said cut out portion sized to accommodate the handle of a paint roller.

22. A lid according to claim 20 comprising a cut out portion located within the periphery of said second open container said cut out portion sized to accommodate the handle of a paint brush.

23. A lid according to claim 22 also comprising a cut out portion at the edge adjacent said central, quadrilateral panel of said first rear wall (A) (4) said cut out portion sized to accommodate the handle of a paint roller.

24. A continuous surface lid having a depending lipped edge said depending lipped edge sized for its inner surface to engage the outer surface of said continuous lipped edge of claim 14 thereby covering said container.

25. A lid according to claim 24 comprising a cut out portion at the edge adjacent said central, quadrilateral panel of said first rear wall (A) (4) said cut out portion sized to accommodate the handle of a paint roller.

26. A lid according to claim 24 comprising a cut out portion located within the periphery of said second open container said cut out portion sized to accommodate the handle of a paint brush.

27. A lid according to claim 26 also comprising a cut out portion at the edge adjacent said central, quadrilateral panel of said first rear wall (A) (4) said cut out portion sized to accommodate the handle of a paint roller.

28. A continuous surface lid having edges tapered from the outer side to the inner side said tapered edges sized for the tapered edges of the lid to engage the inner surface of said container of claim 1 within the continuous lipped edge of the container thereby covering said container.

29. A lid according to claim 28 comprising a cut out portion at the edge adjacent said central, quadrilateral panel of said first rear wall (A) (4) said cut out portion sized to accommodate the handle of a paint roller.

30. A lid according to claim 28 comprising a cut out portion located within the periphery of said second open container said cut out portion sized to accommodate the handle of a paint brush.

31. A lid according to claim 30 also comprising a cut out portion at the edge adjacent said central, quadrilateral panel of said first rear wall (A) (4) said cut out portion sized to accommodate the handle of a paint roller.

32. A lid according to claim 16 comprising a handle means.

33. A lid according to claim 28 comprising a handle means.

34. A container comprising an open topped receptacle formed by a bottom wall, a front wall, two side walls, said side walls having upper edges contained in a plane at the top of the container and a rear wall wherein (1) said front wall further comprises (a) a continuous transition panel in a plane parallel to the bottom wall and sufficiently removed from (b) the plane containing the upper edges of the two side walls to form an opening therebetween thereby forming a lip over which liquid can be poured from said container and (2) said rear wall further comprises (c), a central panel forming a slanted distribution board and (d) support panels extending from the distribution board and adjoining with a side wall, the support panels and sidewalls extending rearward from the edge at which the inset, central panel and the bottom wall join thereby surrounding an area of the bottom wall sufficient to provide stabilizing supporting structure to counteract pressure applied against the inside surface of the distribution board.

35. A container according to claim 1 comprising handle means.

36. A container according to claim 1 further comprising a second opened top receptacle formed by a bottom wall, a front wall, two side walls and a rear wall wherein said rear wall of the second receptacle is attached to the front wall of the first receptacle so that liquid can be poured over the continuous transition panel from the first receptacle to the second receptacle.

37. A container of claim 36 wherein the front wall of said second receptacle forms a pouring spout.

* * * * *